United States Patent [19]

Trotter, Jr.

[11] Patent Number: 4,819,932

[45] Date of Patent: Apr. 11, 1989

[54] AEROBIC EXERCISE FLOOR SYSTEM

[76] Inventor: Phil Trotter, Jr., 9292 East 131st St., Noblesville, Ind. 46060

[21] Appl. No.: 834,819

[22] Filed: Feb. 28, 1986

[51] Int. Cl.[4] ..... A63J 3/00

[52] U.S. Cl. ..... 272/3; 52/480; 52/309.8

[58] Field of Search ..... 272/3, 109; 52/480, 52/390, 393, 309.8, 384, 385, 386, 387, 388, 389

[56] References Cited

U.S. PATENT DOCUMENTS

| | | | |
|---|---|---|---|
| 1,175,316 | 3/1916 | Solon | 52/393 |
| 2,123,409 | 7/1938 | Elmendorf | 52/390 |
| 3,271,916 | 9/1966 | Omholt | 52/393 |
| 3,579,941 | 5/1971 | Tibbals | 52/390 X |
| 3,586,598 | 6/1971 | Beemer | 52/390 X |
| 3,684,630 | 8/1972 | Sensenig et al. | 52/309.8 X |
| 3,828,503 | 8/1974 | Hofmann | 52/390 X |
| 4,233,793 | 11/1980 | Omholt | 52/390 |
| 4,274,626 | 6/1981 | Grosser et al. | 52/402 X |
| 4,290,249 | 9/1981 | Mass | 52/403 X |
| 4,350,721 | 9/1982 | Nagase | 272/109 X |

FOREIGN PATENT DOCUMENTS

| | | | |
|---|---|---|---|
| 681454 | 10/1952 | United Kingdom | 52/384 UX |

*Primary Examiner*—Robert A. Hafer
*Assistant Examiner*—Sam Rimell
*Attorney, Agent, or Firm*—Richard C. Litman

[57] ABSTRACT

A resilient wood floor for aerobic exercise. The boards of the floor are free to pivot in tongue and groove joints. The wood is laid on a foam pad which will always yield during ordinary human exercises. The boards are held together by spring clips which lengthen when a load is applied to the boards, while holding the boards close together in a manner to prevent pinching.

7 Claims, 2 Drawing Sheets

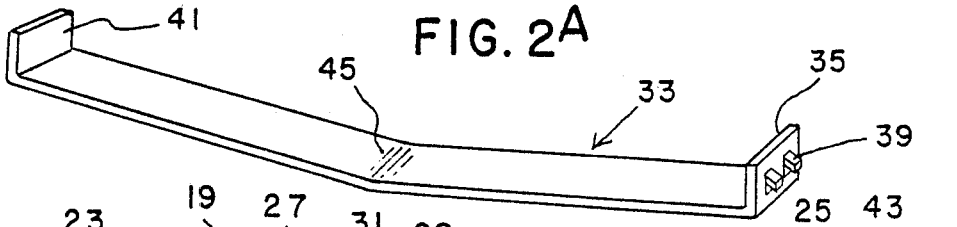
FIG. 2A
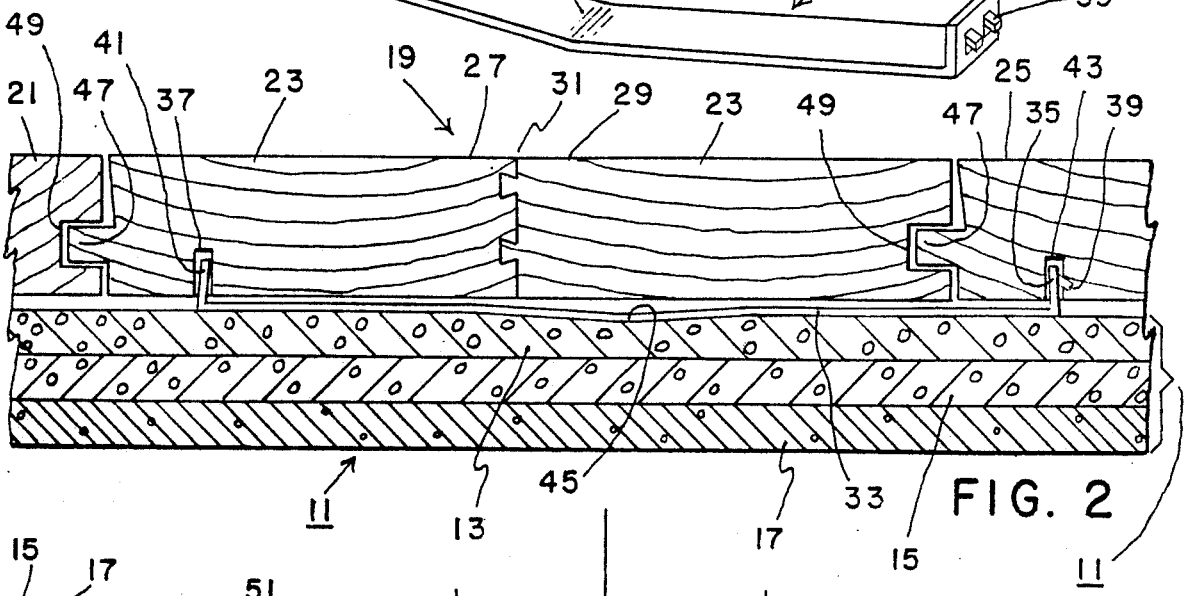
FIG. 2
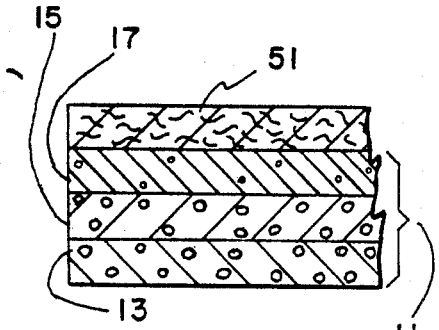
FIG. 4
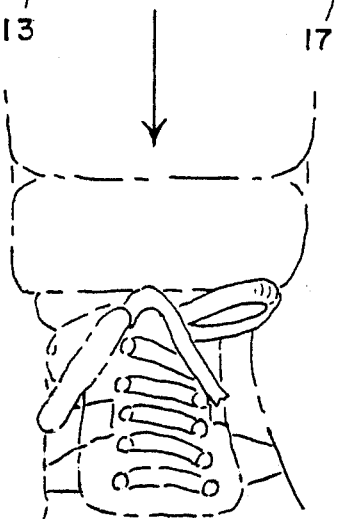
FIG. 3
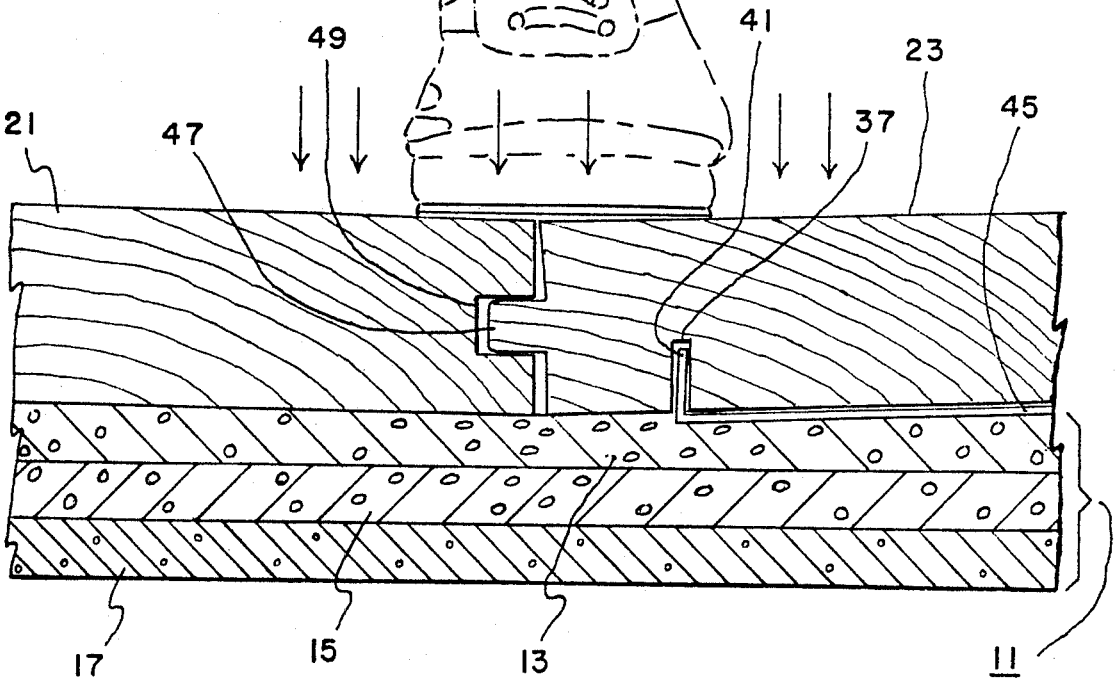

AEROBIC EXERCISE FLOOR SYSTEM

BACKGROUND OF THE INVENTION

This invention relates to aerobic exercise floor systems having the type of resiliency satisfying participants, to pads suitable for creating such floor systems, and to spring clips for holding the wear layer in place and in allowing the wear layer to flex.

A major concern of aerobic professionals is the disproportionate number of instructors and participants who become injured during aerobic exercies. Shin splints, tendonitis, stressed and sore joints, muscle trauma and ankle roll over are examples of the type of injuries which occur. Ultimately it is the floor that must accept responsibility for reducing shock, promoting comfort and protecting against these injuries.

Various flooring systems have been developed to provide a cushioning effect. U.S. Pat. No. 3,684,630 discloses a steel floor having grooves cut into the steel over a foam underlayer. A wear layer is placed over the steel. "The deeper the wear layer is depressed the greater is the tendency to rupture the wear layer and to crush the underlying material", according to the patent describing the mechanics of a wear material with limited load distributing factors. For an exercise floor, the continuous flexing of the steel where the grooves have been cut could cause flex cracking of the joints. U.S. Pat. No. 3,388,516 discloses the use of corrugated steel as a cushioning material as an improvement over concrete. U.S. Pat. No. 3,902,293 discloses bonded floor tile over a network of filaments containg spheroidal cells of gas as an improvement over bonding the floor tile directly to the sub floor. The tile are locked together by tongue and groove on all four sides, or by adhesive. U.S. Pat. No. 4,169,688 discloses an artificial ice skating ring floor on a layer of cushion material. The floor plates are held together by U shaped insertion members.

SUMMARY OF THE INVENTION

The floor system of the present invention aids leg motion in both the lateral and vertical directions. In vertical motion the leg carries considerable energy against the surface. The floor system of the present invention absorbs the energy and deflects under the impact to disperse the energy away from the legs and feet to reduce the shock of the impact. The floor system of the present invention is also firm enough to provide some rebound. Also, a firm surface stabilizes the feet and lessens the chance of ankle injury caused by foot rollover.

The surface of the floor system of the present invention provides the proper traction for lateral and rotational motion to accomplish the necessary sliding, twisting and turning found in today's tough aerobic routines. The preferred surface is a wood surface having a floating air cushioned suspension system to provide energy return qualities. In addition, the necessary traction for horizontal and rotational movement can be provided by appyling various types of finishes. And finally, wood is much more hygienic and easier to maintain than carpet which harbors bacteria and odors that require cleaning with a hot-water extractor and sanitizer at least weekly.

The cushioned floor of the present invention is made up of a number of elements. A lower layer of a foamed pad has a sufficient thickness and compressive strength that it will not bottom out i.e., it will always yield to static and impulsive loading when used by humans doing exercise on the floor. An attrition resistant upper layer of boards joined at a pivoting tongue and groove joints provides an exercising surface. The lengthwise direction of the boards runs in the same direction as the joints. A slot is provided in each board parallel to the joints. A U shaped spring clip having upright legs is inserted into the slots. One leg of the spring clip contains one or more cleats which protrude away from the direction of insertion of the legs and toward a wall of one slot. The combined width of the cleat and the leg inserted in the slot are wider before insertion into the slot than the slot whereby the leg containing the cleats is locked into the slot into which it is inserted thus holding the spring clip in place. The boards are held together by tension in the spring clip, the spring clip being curved in the lengthwise direction between the legs when there is no load on the boards; so that when a load is applied and the boards flex, the curved portion straightens so as not to unduly restrain the joint from flexing. While a minimum number of boards required to practice the present invention is two, in actual practice a plurality of boards is used to cover the entire exercise area, each board joined to each adjacent board by spring clips The foamed pad is inventive in its own right. The foamed pad has a thickness of about one half inch to about an inch and one half and a reaction to compressive loading of about 12 to 16 pounds per square inch at 50% deflection. The pad preferable has at least two layers and more preferably three layers, one surface layer of which has a density of approximately one half the density of the opposed surface layer. The less dense side is the upper layer of the pad when placed under the boards. The pad is preferably made of flexible closed-cell polyethylene foam which is crosslinked by electron irradiation.

The cleats of the spring clip are preferably formed from the material of the leg to which the cleats are attached. The cleats form an angle of less than 90 degrees with the surface of the leg from which they were cut. The cleats preferably extend at an angle of from 25 degrees to 60 degrees from the surface of the leg to which the cleats are attached.

Preferably the attrition resistant layer of boards of the floor are made of wood which has been press-dried with pressure on faces of the boards to reduce shrinkage in the face width.

The pad can also be used under a carpet as an exercise floor though this is not preferred. When the multilayer pad is used under carpet the denser side is used as the top side of the pad.

BRIEF DESCRIPTION OF THE DRAWINGS

FIG. 2 is an end view of a section of the exercise floor.

FIG. 2A is a view of the spring clip.

FIG. 3 shows the deflection of tthe exercise floor during use.

FIG. 4 is a view of an exercise floor using a carpet.

DETAILED DESCRIPTION

Figure 1:
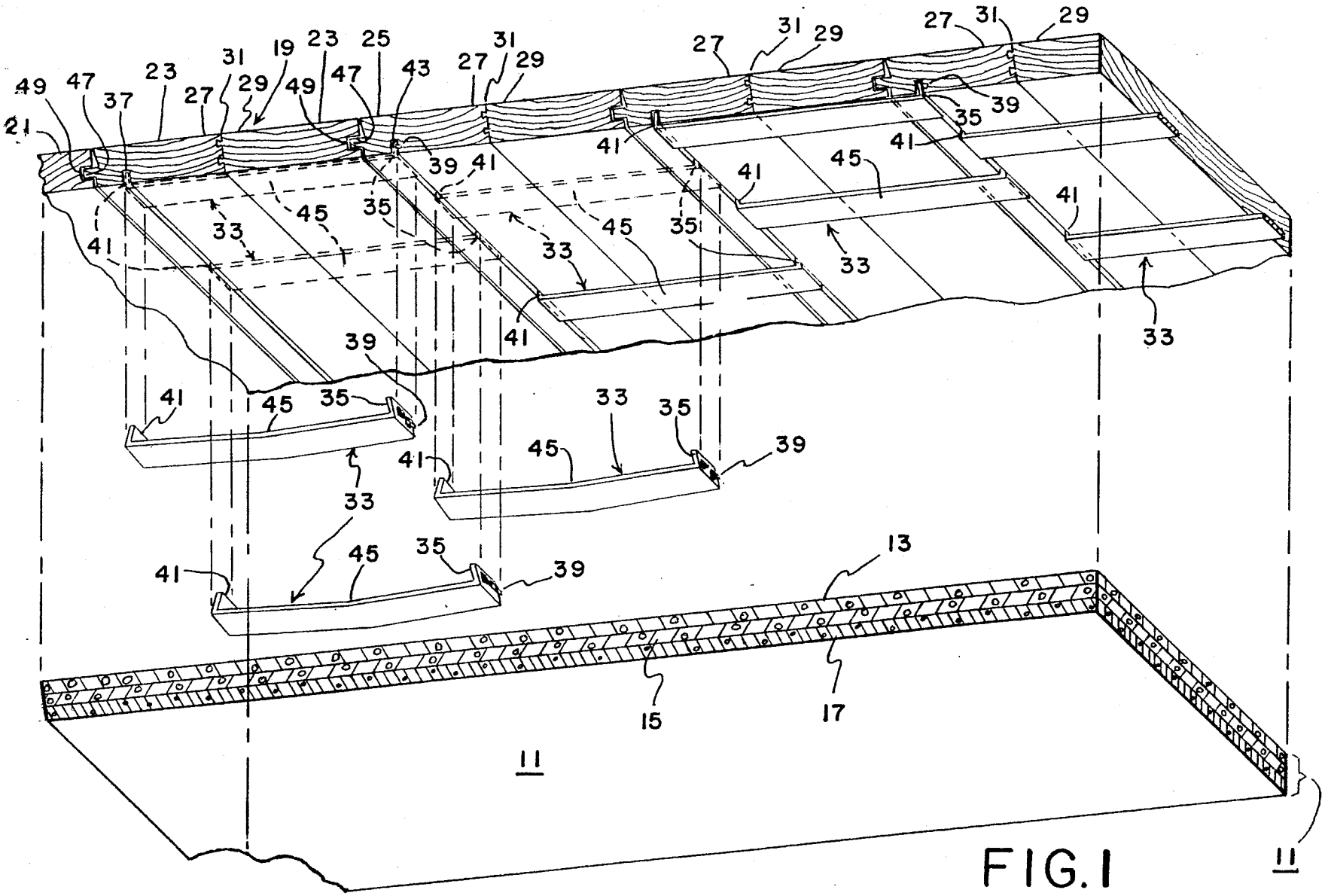
FIG. 1 is an exploded view of the preferred exercise floor.

Referring now to the drawings. A bottom layer 11 is a pad made of flexible closed-cell polyethylene foam which is cross linked by means of an electron irradiation process. It is made as a continuous, smooth sheet with small cells. The foam is in the form of a three layer pad 11. The layers are one-fourth of an inch thick and thermally laminated to each other. The top layer 13 and center layer 15 each have a two pounds per square foot density, and the bottom layer 17 has a four pound per square foot density. The pad 11 is resistant to high temperatures, has a very low water absorption capability, does not transmit moisture, has excellent thermal insulation characteristics and is resistant to most chemicals. The technical properties of the pad 11 are as follows.

1. Compression Strength—12.7 to 15.5 pounds per square inch at 50 percent deflection.
2. Compressive Set—16 percent maximum of original thickness after 22 hours of loading and 24 hours of recovery.
3. Tensile Srength—45 to 55 pounds per square inch.
4. Elongation—124 percent to 152 percent to break in the machine direction.
5. Tear Resistance—10 to 12 pounds per square inch in the machine direction.
6. Shore Hardness—typical value of 7 on the AA scale.
7. Thermal Stability—1.5 percent maximum shrinkage over a three hour period with no load at 180 degrees Fahrenheit.
8. Load Temperature Brittle Point—minus 110 degrees Fahrenheit.
9. Thermal Conductivity—0.25 BTU per hour, foot squared, degrees Fahrenheit per inch K factor at 7 degrees Fahrenheit.
10. Water Absorption—0.04 pounds per square foot of cut surface.

Above the pad 11 is flooring 19, which is a series of boards including boards 21, 23 and 25. The boards 21, 23 and 25 are machined tongue and grooved, end-matched and assembled from contiguous and adjacent beech strips 27 and 29. The strips 27 and 29 are assembled at the longitudinal joint 31 by means of a jointer using a double dovetail and permanently glued using a polyvinyl acetate adhesive centrally located in the boards 21, 23 and 25. A standard grade of beech is used and each board 21, 23, and 25 is five and one sixth inches wide by twelve foot one and five eights inches long by seven eights of an inch thick. The boards 21, 23 and 25 weigh 3.28 pounds per square foot.

The beech flooring boards 21, 23 and 25 are pressed-dried to stabilize the expansion thrust of the floor. The press drying process is a drying method by which heated plates having a temperature of 345 degrees Fahrenheit are pressed against the top and bottom face of each flooring strip 27 and 29 at a pressure of 170 pounds per square inch. Through this drying process, shrinkage occurs only in the thickness and not in the face width, as pressed dried boards expand in the thickness first.

During the press drying process, the strength of the beech is increased by 15 percent. The green beech is at a thickness of one and one fourth inches prior to drying. After the drying process the beech has been compressed to a nominal one inch in thickness. The specific gravity of the beech is increased by approximately 10 percent. Therefore the press drying not only stabilizes the beech flooring 19, but also increases the load bearing capability of the flooring 19.

Each board 21, 23 and 25 is sanded to a perfectly smooth seven eights inch thickness, and finished with 3 coats of two component polyurethane. The finish is automatically applied to the boards 21, 23 and 25 in three treatments in a seal curtain coating plant which gives the greatest possible uniformity in the thickness of the finish. Prior to applying the finish, the boards 21, 23 and 25 are preheated with infrared rays so that the penetration of the lacquer into the grain of the wood is considerably increased. This gives the highest durability and adhesion for the next coat of finish. To obtain the best results, the boards 21, 23 and 25 are mechanically sanded before the second and third coat of finish is applied.

The boards 23 and 25 are held together by spring clip 33. Leg 35 of monolithic spring clip 33 is first inserted into groove 37 of board 23, and is locked in place by cleat 39. Board 23 with spring clip 33 attached is then laid on pad 11. Board 25 is then laid with leg 41 inserted into groove 43.

Foot pressure as shown in FIG. 3 pushes boards 23 and 25 down into pad 11, and causes the curve 45 in spring clip 33 to straighten. Also tongue 47 and groove 49 rotate slightly with respect to each other. There is sufficient freedom on play between tongue 47 and groove 49 so as not to restrain boards 23 and 25 from reacting to the pressure or to cause breakage of tongue 47.

The flooring system can be installed over any level subfloor in a day or two and can be disassembled and reassembled easily.

Referring now to FIG. 4, a carpet 51 is laid over pad 11. A carpet with a synthetic backing withstands constant cleaning and bacterial growth. One tenth gauge and 24 to 26 ounce carpeting is advised for longest wear. Cut pile reduces friction and hides seams. Seams are heat sealed. A bacteriostat incorporated into the material of the carpet 51 inhibits bacterial growth.

Various modifications of the invention are possible without departing from the scope of the appended claims.

I claim:

1. A cushioned floor comprising in combination:

a lower layer of a foamed pad having sufficient thickness and compressive strength that it will always yield when used with static and impulsive loading caused by humans doing exercise on the floor;and an attrition resistant upper layer of at least two distinct boards each board comprised of a pair of adjacent contiguous strips, said strips joined to each other by a longitudinal dove tail joint centrally located in said board, said at least two distinct boards having at least one tongue and groove pivoting joint joined with play, said at least one tongue and groove pivoting joint having one lengthwise direction, a slot running parallel to said lengthwise direction of said pivoting joint in alternate strips of said at least two distinct boards, a U-shaped resilient monolithic clip having upright legs inserted into the slots overlapping and asymmetrical to said centrally located longitudinal dove tail joint, one leg of which contains at least one cleat which protrudes away from the directions of the legs and toward a wall of one slot, the combined width of the cleats and the leg inserted in the one slot being wider thus the one slot before insertion into the slot whereby the leg containing said at least one cleat is locked into the slot into which it is inserted thus holding the spring clip in place, the boards being held together by tension in the spring clip, the spring clip being curved in the lengthwise direction between the legs when there is no load on the boards;

so that when a load is applied and the boards flex, the curved portion straightens so as not to unduly restrain the joint from flexing.

2. A floor of claim 1 having a plurality of more than two boards, each board joined to each adjacent board by one or more of the spring clips.

3. A floor of claim 1 wherein the foamed pad has a thickness of from one half to two inches.

4. A floor of claim 1 wherein the foamed pad has a thickness of about three quarters of an inch and a compressive strength of about 12 to 16 pounds per square inch at 50% deflection.

5. A floor of claim 4 wherein the foamed pad comprises an upper layer and a lower layer, the upper layer of which has a density of approximately one half the density of the lower layer.

6. A floor of claim 1 wherein the foamed pad comprises flexible closed-cell polyethylene foam.

7. The floor of claim 1 wherein the one or more cleats are formed from the material of the leg to which the one or more cleats are attached, and the one or more cleats form an angle of less than 90 degrees with a plane formed by an opening created by the formation of the one or more cleats.

* * * * *